US007225629B2

(12) United States Patent
Concha et al.

(10) Patent No.: US 7,225,629 B2
(45) Date of Patent: Jun. 5, 2007

(54) ENERGY-EFFICIENT HEAT PUMP WATER HEATER

(75) Inventors: Julio Concha, Rocky Hill, CT (US); Tobias Sienel, Easthampton, MA (US); Bryan A. Eisenhower, East Hartford, CT (US)

(73) Assignee: Carrier Corporation, Syracuse, NY (US)

( * ) Notice: Subject to any disclaimer, the term of this patent is extended or adjusted under 35 U.S.C. 154(b) by 98 days.

(21) Appl. No.: 10/760,668

(22) Filed: Jan. 20, 2004

(65) Prior Publication Data

US 2005/0155364 A1 Jul. 21, 2005

(51) Int. Cl.
*F25D 17/00* (2006.01)
*F25B 39/04* (2006.01)
*F25B 27/00* (2006.01)

(52) U.S. Cl. ..... 62/181; 62/183; 62/238.7

(58) Field of Classification Search ..... 62/183, 62/181, 108, 238.6, 238.7, 127; 237/2 R, 237/2 B; 236/21 B, 20 R, 25 R
See application file for complete search history.

(56) References Cited

U.S. PATENT DOCUMENTS 4,492,091 A * 1/1985 Whitwell et al. ..... 62/180
5,367,602 A * 11/1994 Stewart ..... 392/308
6,212,894 B1 4/2001 Brown et al.
6,370,896 B1 * 4/2002 Sakakibara et al. ..... 62/201
6,494,051 B2 12/2002 Sakakibara et al.

FOREIGN PATENT DOCUMENTS

| | | | |
|---|---|---|---|
| EP | 0092864 | | 11/1983 |
| JP | 62010535 A | * | 1/1987 |
| JP | 2004159 | | 1/1990 |
| JP | 2001255005 | | 9/2001 |
| JP | 2002147846 | | 5/2002 |
| JP | 2002243276 | | 8/2002 |
| JP | 2002295901 | | 10/2002 |
| JP | 2003372326 | | 12/2002 |
| JP | 2003050051 | | 2/2003 |
| JP | 2003130459 | | 5/2003 |
| JP | 2003148809 | | 5/2003 |
| WO | WO03042606 | | 5/2003 |

* cited by examiner

*Primary Examiner*—Chen Wen Jiang
(74) *Attorney, Agent, or Firm*—Carlson, Gaskey & Olds

(57) ABSTRACT

An energy-efficient heat pump water heating system determines whether to energize a heat pump by interpreting readings from one or temperature sensors based on two thresholds. The heat pump is energized if the detected temperature falls below a first threshold and de-energized when the detected temperature rises above a second threshold. The thresholds may correspond to outputs of two or more sensors. Using multiple temperature thresholds improves the temperature sensing capabilities of the system, thereby improving energy efficiency by matching heat pump operation with hot water demand more closely than previously known systems.

14 Claims, 2 Drawing Sheets

ENERGY-EFFICIENT HEAT PUMP WATER HEATER

TECHNICAL FIELD

The present invention relates to water heaters, and more particularly to heat pump water heaters.

BACKGROUND OF THE INVENTION

Hot water heaters monitor water temperature to determine when water should be heated to maintain a selected water temperature level. Heaters incorporating heat pumps to heat the water energize and de-energize a heat pump based on a measured temperature. If the temperature falls below a selected threshold, the heat pump may be energized to reheat the water. When demand for hot water drops, the heat pump may be de-energized. Operation of the heat pump should accurately track hot water demand to ensure maximum heating efficiency.

Water in the tank tends to stratify, with hot water at the top of the tank near a hot water outlet pipe and cold water at the bottom of the tank near a cold water inlet pipe. Water heated by the heat pump is deposited at the top of the tank, providing additional water that can be output via the output pipe. Thermometers may be placed in the outlet pipe, the inlet pipe, and/or a water pump that sends water to the heat pump to determine whether to energize the heat pump, but the stratification of the water in the tank makes it difficult for the temperature reading to accurately reflect the water temperature in the tank itself through temperature measurements in the pipes. Although it is possible to circulate the water through the de-energized heat pump and the tank to eliminate the stratification before measuring temperature, this would send cold water to the hot water at the top of the tank, undesirably lowering the overall water temperature and potentially requiring the heat pump to energize even though there originally may have been enough hot water at the top of the tank to meet demand. Because of this, any disturbance in the stratification of water in the tank is considered undesirable.

It is possible to place a temperature sensor at the hot water outlet pipe itself because this temperature would reflect the water that will be output to a user. However, if there is no demand for hot water for an extended period of time, the water in the tank may be cooler than the water in the outlet pipe. While the heat pump may be energized as soon as the water flowing through the outlet pipe reflects the lowered temperature of the water in the tank, the large amount of water in the tank causes a long time delay between the time the temperature drop is detected and the time the water is hot enough to use. Thus, currently known systems are unable to provide a temperature reading that is relevant enough to the temperature of usable hot water in the tank to accurately indicate whether the heat pump should be energized.

There is a desire for a system that can provide relevant, accurate temperature information for determining whether to energize a heat pump, improving energy efficiency.

SUMMARY OF THE INVENTION

The present invention is directed to an energy-efficient heat pump water heating system. In one embodiment, the system determines whether to energize a heat pump by interpreting readings based on one or more strategically placed temperature sensors based on two thresholds. The heat pump is energized if the detected temperature falls below a first threshold and de-energized when the detected temperature rises above a second threshold. In an alternative embodiment, the thresholds may correspond to outputs of two or more sensors; for example, the heat pump may be energized if a reading from a first sensor drops below a first threshold and de-energized if a reading from a second sensor moves above a second threshold. Using multiple thresholds improves the temperature sensing capabilities of the system, thereby improving energy efficiency by matching heat pump operation with hot water demand more closely than previously known systems.

DETAILED DESCRIPTION OF THE EMBODIMENTS

Figure 1:
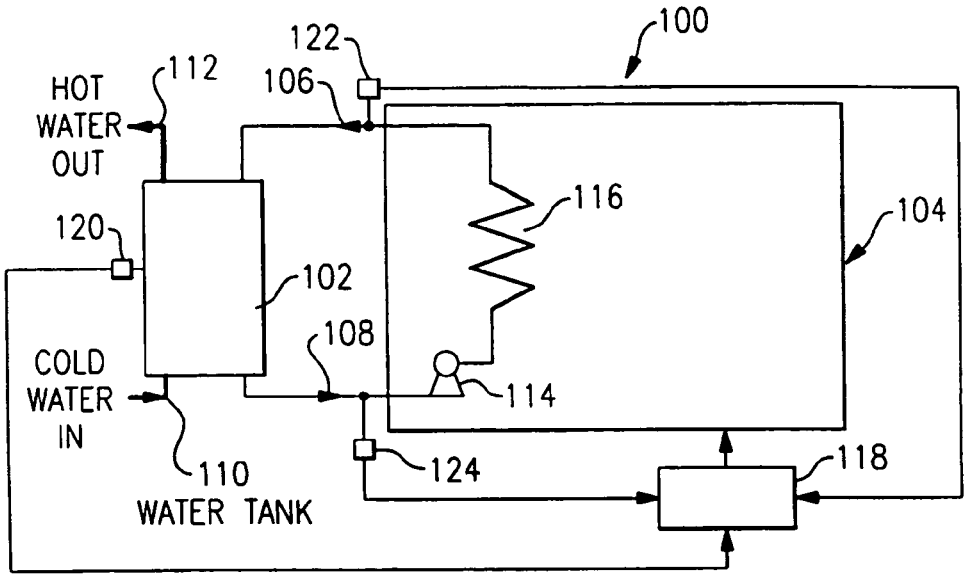
FIG. 1 is a representative diagram of a heat pump water heater according to one embodiment of the invention.

FIG. 1 is a representative diagram of a heat pump water heater 100 according to one embodiment of the invention. In the illustrated embodiment, the heater 100 includes a water tank 102 connected to a heat pump 104. Water circulates between the tank 102 and the heat pump 104 via pipes, including a tank inlet pipe 106 and a tank outlet pipe 108. The tank inlet pipe 106 carries hot water heated by the heat pump 104 and deposits in into the top of the tank 102, while the tank outlet pipe 108 directs cold water from the bottom of the tank 102 to the heat pump 104 to be heated.

In addition to the pipes directing water between the tank 102 and the heat pump 104, other pipes are included to link the heat pump water heater 100 to external systems. In this example, a cold water tank inlet pipe 110 supplies cold water from an external source (not shown) to the bottom of the tank 102 for eventual heating by the heat pump 104. A hot water tank outlet pipe 112 at the top of the tank 102 removes hot water from the tank for use.

The heat pump 104 itself includes a water pump 114 and a heat exchanger 116. The heat pump 104 may employ a transcritical vapor compression cycle, if desired, and may employ any appropriate refrigerant, such as carbon dioxide. Although the water pump 114 is shown in the path of the tank outlet pipe 108 in this embodiment, the water pump 114 may also be located in the tank inlet pipe 106 without departing from the scope of the invention. The water pump 114 pumps water through the heat exchanger 116, where it absorbs heat. Once the pumped water has absorbed heat through the exchanger, it travels through the tank inlet pipe 106 and is delivered to the tank 102 for storage. A controller 118 controls energization and de-energization of the heat exchanger 116; in the illustrated example, the controller 118 controls operation of the water pump 114 and the heat exchanger 116 independently so that water can be circulated by the water pump 114 while the heat exchanger 116 is de-energized, if desired.

One or more temperature sensors are included in the heater 100 to monitor water temperature in the tank 102 and energize/de-energize the heat pump 104 (i.e., energize/de-energize both the water pump 114 and the heat exchanger 116) based on whether or not the water temperature needs to be raised and based on hot water demand.

To avoid irrelevant water temperature measurements due to stratification in the tank 102 and cooling of the water in the tank 102 after prolonged disuse of the water, a tank temperature sensor 120 is disposed at roughly the midpoint of the tank 102 or at any other desired location in the tank 102. Placing a temperature sensor 120 in the tank 102 allows direct measurement of the water temperature in the tank, making the temperature reading relevant in determining whether to operate the heat pump 104 without requiring recirculation of water through the heater 100. More particularly, the water temperature in the tank 102 will provide a better indication than the water temperature in any of the pipes 106, 108, 110, 112 regarding whether the water in the tank needs to be heated even with the stratification effect of different water temperatures in the tank 102.

The tank temperature sensor 120 provides a temperature reading to the controller 118. In one embodiment, the controller 118 evaluates the temperature reading with a predetermined first threshold and energizes the heat pump 104 if the temperature drops below the first threshold, indicating that the water temperature in the tank 102 is not high enough to meet hot water demand. Evaluating water temperature using two separate thresholds provides a more accurate indication of the demand for hot water without requiring recirculation of cold water into the hot water at the top of the tank. As a result, the heat pump 104 will operate only in response to hot water demand and not when stratification is disturbed due to recirculation.

To add further control over heat pump operation, the controller 118 may instruct the heat pump 104 to de-energize when a temperature reading reaches a second threshold. The temperature reading may be taken from the tank temperature sensor 120 or from another temperature sensor in the system. If the tank temperature sensor 120 is evaluated based on both the first and second thresholds, the heat pump 104 may simply be energized if the temperature falls below the first threshold and de-energized when it reaches the second threshold.

In another embodiment, the second threshold may evaluate a temperature reading from a tank inlet temperature sensor 122 placed in the tank inlet pipe 106, which measures the temperature of hot water being deposited into the top of the tank 102. This temperature reading is then used to estimate the water temperature in the tank outlet pipe 108 based on the system 100 heating capacity and the water flow rate through the system 100 using, for example, the following relationship:

$$\text{heating capacity} = K * \text{water flow} * (\text{inlet pipe temp} - \text{outlet pipe temp})$$

where K is the specific heat of water. Using one sensor and calculating the estimated water temperature elsewhere allows fewer sensors to be used in the system.

Alternatively, a tank outlet temperature sensor 124, which may be any temperature sensor near the bottom of the tank 102, may be included to measure the water temperature in the tank outlet pipe 108 directly. Using two sensors, one near the top of the tank 102 and one near the bottom of the tank 102 or along the tank outlet pipe 108, provides greater control over heat pump operation than a single sensor because the sensor near the top of the tank 102 can be used to decide when to turn the heat pump on and the sensor near the bottom of the tank 102 or in the tank outlet pipe 108 can be used to decide when to turn the heat pump off. Regardless of the specific location of the sensors, measuring water temperature in a given pipe should be conducted when the water pump 114 is operating and moving water through the system to obtain the most relevant reading.

Figure 2:
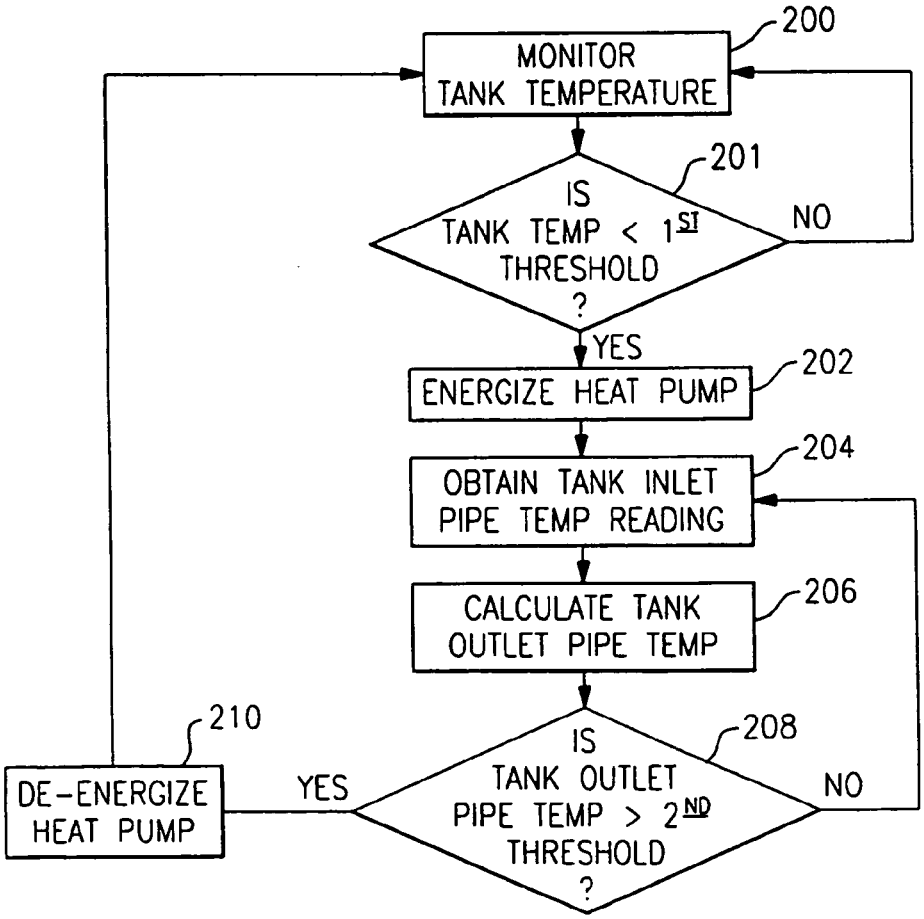
FIG. 2 is a flow diagram illustrating a heat pump control process according to one embodiment of the invention.

FIG. 2 illustrates a method of controlling the heat pump in this manner according to one embodiment of the invention. In this embodiment, the tank temperature sensor 120 monitors the tank temperature and sends the temperature reading to the controller 118 (block 200). The controller 118 checks whether the tank temperature reading falls below the first threshold (block 201). If so, the heat pump is energized (block 202) to heat water as it circulates through the heat pump. This will cause the overall water temperature in the tank 102 to rise gradually as the heated water mixes with the cooler water in the tank 102. The temperature of the heated water flowing through the tank inlet pipe 106 is then monitored (block 204). The temperature reading is used to calculate the water temperature in the tank outlet pipe 108 based on the system heating capacity and the water flow rate, as explained above (block 206). The accuracy of the temperature calculation will depend on how closely the capacity and flow rate values match the system's actual operating characteristics. If the calculated tank outlet pipe temperature reaches a second threshold (block 208), indicating that the hot water temperature has met hot water demand, the heat pump 104 is de-energized (block 210) until the tank water temperature drops below the first threshold again.

Figure 3:
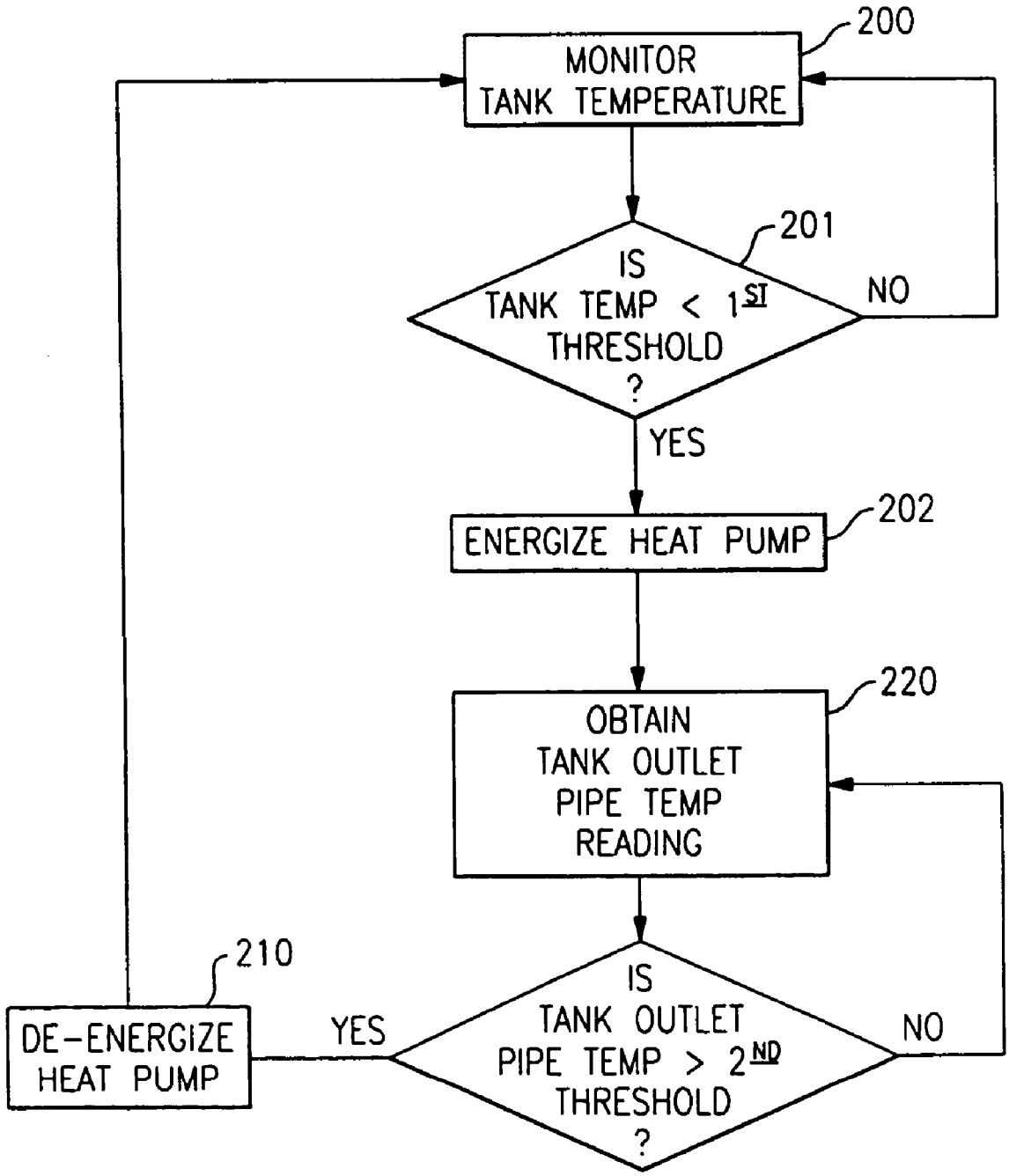
FIG. 3 is a flow diagram illustrating a heat pump control process according to another embodiment of the invention.

Alternatively, or in addition, the system may evaluate a temperature reading from the tank outlet pipe 108 directly. FIG. 3 illustrates a method according to another embodiment of the invention. In this embodiment, the water temperature in the tank outlet pipe 108 is monitored directly by the tank outlet temperature sensor 124, thereby eliminating the need to estimate the tank outlet pipe temperature as in the previous embodiment. In this embodiment, the method simply de-energizes the heat pump 104 if the temperature in the tank outlet pipe 108 reaches the second threshold (block 220).

Thus, the invention improves energy efficiency by energizing the heat pump 104 only when needed. By measuring the water temperature in the middle of the tank and by evaluating water temperature using two different thresholds, the invention avoids unnecessary circulation and reheating, improving energy efficiency while still responding accurately to hot water demand.

It should be understood that various alternatives to the embodiments of the invention described herein may be employed in practicing the invention. It is intended that the following claims define the scope of the invention and that the method and apparatus within the scope of these claims and their equivalents be covered thereby.

What is claimed is:

1. A fluid heating system, comprising:

a heat pump;

a tank;

a tank inlet that carries fluid from the heat pump to the tank;

a tank outlet that carries fluid from the tank to the heat pump;

a tank temperature sensor that measures a fluid temperature in the tank;

a controller that controls the heat pump based on a first threshold, a second threshold higher than the first threshold, and at least an output from the tank temperature sensor, wherein the controller energizes the heat pump when the tank temperature sensor output falls below the first threshold, said controller causing the heat pump to de-energize when a temperature within the fluid heating system reaches the second threshold;

a tank inlet temperature sensor, wherein the controller de-energizes the heat pump when a value based on an output from the tank inlet temperature sensor reaches the second threshold; and the value is an estimated tank outlet temperature calculated from the output from the tank inlet temperature, a system capacity and a flow rate, and wherein the controller causes the heat pump to de-energize if the estimated tank outlet temperature reaches the second threshold.

2. The fluid heating system of claim 1, wherein the controller causes the heat pump to de-energize when the tank temperature sensor reaches the second threshold.

3. The fluid heating system of claim 1, wherein the heat pump employs a transcritical vapor compression cycle.

4. The fluid heating system of claim 1, wherein the heat pump uses carbon dioxide as a refrigerant to obtain the transcritical vapor compression cycle.

5. The fluid heating system of claim 1, wherein the tank temperature sensor is disposed generally at a midpoint portion of the tank.

6. A fluid heating system, comprising:

a heat pump;

a tank;

a tank inlet that carries fluid from the heat pump to the tank;

a tank outlet that carries fluid from the tank to the heat pump;

a tank temperature sensor that measures a fluid temperature in the tank;

a controller that controls the heat pump based on a first threshold, a second threshold higher than the first threshold, and at least an output from the tank temperature sensor, wherein the controller energizes the heat pump when the tank temperature sensor output falls below the first threshold, said controller causing the heat pump to de-energize when a temperature within the fluid heating system reaches the second threshold; and a tank outlet temperature sensor, wherein the controller de-energizes the heat pump when an output from the tank outlet temperature sensor reaches the second threshold.

7. A fluid heating method, comprising, comprising:

measuring a tank temperature; and controlling a heat pump based on a first threshold, a second threshold higher than the first threshold, and at least the tank temperature, wherein the heat pump is energized when the tank temperature falls below the first threshold, causing the heat pump to de-energize when a temperature within the fluid heating system reaches the second threshold;

measuring a tank inlet temperature, wherein the controlling step comprises de-energizing the heat pump when a value based on the tank inlet temperature reaches the second threshold; and calculating the value of an estimated tank outlet temperature from the tank inlet temperature, a system capacity and a flow rate, and wherein the heat pump is de-energized if the estimated tank outlet temperature reaches the second threshold.

8. The fluid heating method of claim 7, wherein the controlling step comprises de-energizing the heat pump when the tank temperature reaches the second threshold.

9. The fluid heating method of claim 7, further comprising measuring a tank outlet temperature, wherein the controlling step comprises de-energizing the heat pump when the tank outlet temperature reaches the second threshold.

10. A fluid temperature control for a fluid heating system, comprising:

a heat pump;

a tank temperature sensor that measures a fluid temperature in a tank;

a controller that controls the heat pump based on a first threshold, a second threshold higher than the first threshold, and at least an output from the tank temperature sensor, wherein the controller energizes the heat pump when the tank temperature sensor output falls below the first threshold, said controller causing the heat pump to de-energize when a temperature within the fluid heating system reaches the second threshold;

a tank inlet temperature sensor, wherein the controller de-energizes the heat pump when a value based on an output from the tank inlet temperature sensor reaches the second threshold; and the value is an estimated tank outlet temperature calculated from the output from the tank inlet temperature, a system capacity and a flow rate, and wherein the controller causes the heat pump to de-energize if the estimated tank outlet temperature reaches the second threshold.

11. The fluid temperature control of claim 10, wherein the controller causes the heat pump to de-energize when the tank temperature sensor reaches the second threshold.

12. The fluid temperature control of claim 10, further comprising a tank outlet temperature sensor, wherein the controller de-energizes the heat pump when an output from the tank outlet temperature sensor reaches the second threshold.

13. The fluid temperature control of claim 10, wherein the heat pump employs a transcritical vapor compression cycle.

14. The fluid temperature control of claim 13, wherein the heat pump uses carbon dioxide as a refrigerant to obtain the transcritical vapor compression cycle.

* * * * *